US010815096B2

(12) United States Patent
Bourg

(10) Patent No.: US 10,815,096 B2
(45) Date of Patent: Oct. 27, 2020

(54) AUTOMATED METHOD FOR THE PRODUCTION OF PRINTED WORKS

(71) Applicant: C.P. Bourg S.A., Court-Saint-Etienne (BE)

(72) Inventor: Charles Bourg, Woluwe-Saint-Lambert (BE)

(73) Assignee: C.P. Bourg S.A., Court-Saint-Etienne (BE)

( * ) Notice: Subject to any disclaimer, the term of this patent is extended or adjusted under 35 U.S.C. 154(b) by 0 days.

(21) Appl. No.: 16/407,494

(22) Filed: May 9, 2019

(65) Prior Publication Data

US 2019/0344990 A1 Nov. 14, 2019

(30) Foreign Application Priority Data

May 11, 2018 (BE) ..... 2018/5310

(51) Int. Cl.
*B65H 45/18* (2006.01)
*B41F 17/02* (2006.01)

(52) U.S. Cl.
CPC ..... *B65H 45/18* (2013.01); *B41F 17/02* (2013.01); *B42P 2261/04* (2013.01)

(58) Field of Classification Search
None
See application file for complete search history.

(56) References Cited

U.S. PATENT DOCUMENTS

2006/0028662 A1 2/2006 Dobrovolsky
2007/0179037 A1 12/2007 Dobrovolsky
2012/0306141 A1 12/2012 McIntyre
2017/0129269 A1 5/2017 Dobrovolsky
2019/0344600 A1 11/2019 Bourg et al.

FOREIGN PATENT DOCUMENTS

DE 195 39 930 5/1996
DE 102014111669 1/2016
WO 2011/108935 A1 9/2011

OTHER PUBLICATIONS

U.S. Appl. No. 16/407,529, filed May 9, 2019, Bourg.

*Primary Examiner* — Lennin R Rodriguezgonzalez
(74) *Attorney, Agent, or Firm* — McDonnell Boehnen Hulbert & Berghoff LLP

(57) ABSTRACT

The invention concerns an automated method for manufacturing printed publications, for the flexible production, on demand, of a single publication or small series of publications. To this end, an automated method is proposed for the production of printed publications, each consisting of a content block (425) and a cover (426), according to which:

- the feasibilities of manufacturing the content blocks (425) of the publications are determined (414),
- an order of priority is established for the manufacture of the publications,
- the covers (426) to be assembled with the content blocks are manufactured,
- the manufacture of the content blocks (425) is ordered according to descending order of priority subject to feasibility, which takes precedence over manufacturing priority, and
- the content blocks (425) are assembled with the corresponding covers (426).

6 Claims, 1 Drawing Sheet

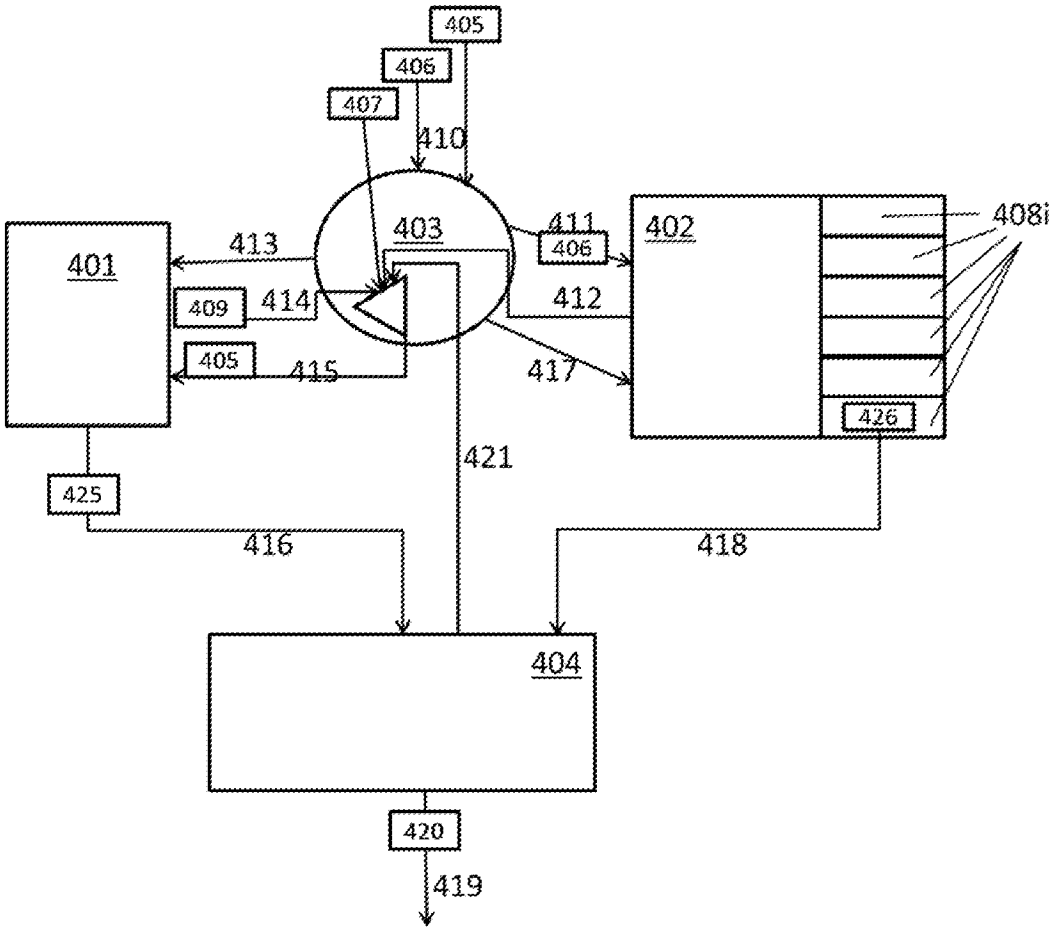
408i
426
402
418
411
406
412
417
405
410
406
407
403
421
404
420
419
413
414
409
415
405
416
401
425

AUTOMATED METHOD FOR THE PRODUCTION OF PRINTED WORKS

CROSS-REFERENCE TO RELATED APPLICATION

This application claims priority to Belgium Patent Application No. 2018/5310, filed May 11, 2018, which is incorporated by reference herein in its entirety.

The invention concerns the field of digital printing of printed works or publications, in particular the flexible production, on demand, of a single publication or small series of identical publications.

The manufacture of printed works, such as books, catalogs, personalized photo books or advertising brochures, requires a certain number of steps comprising printing content on a medium, in particular paper or cardboard, and the finishing of the publication, in particular binding, by various means (gluing, stapling, etc.), of the content block of the publication and its assembly with the cover. It may also comprise the assembly of several printed contents, reformatting, cutting off of margins/unprinted edges, etc.

Digital printing has changed the work of printers, making the printing of small series or even a single publication cost-effective.

The trend towards personalization of publications and minimum storage (lean manufacturing) means that printers are increasingly required to print on demand a single copy of each publication and thus be very flexible in their production methods. The production of a printed publication generally ends with the assembly of the content block with a cover, if the publication comprises one. As the cover of the publication is printed separately, several methods are used to complete this assembly. In general, the leaves composing the inside of the publication, i.e. the content block, are printed and prepared by a different system than the one used to prepare the cover of the publication. When a single publication is printed in numerous identical copies, it is quite simple to assemble the contents of the publication with the cover thereof, starting from a stock of contents and a stock of covers.

As modern systems aim to be flexible and allow for the on-demand printing of a single copy of a publication, managing the assembly of the content with the cover becomes more complex. This includes optimizing printing resources to produce many publications in a row, all different.

Systems exist, wherein the publication covers are printed by a first printing system and stacked in a certain order in a cover storage rack. The first cover of the stack is identified by detection means, such as a barcode reader. Identification triggers the printing/manufacture of the publication's content by a second system. The content and the cover are then assembled. The same steps are repeated for the following covers of the stack.

These systems have a certain number of drawbacks that alter production efficiency. Take, for example, a list of five pending publications, comprising, for example, two publications to be bound by gluing, one publication to be bound by stapling and then two publications to be bound by gluing. The five covers are printed and stacked in order in a storage rack. The first two covers will subsequently be identified, the associated content will be prepared and assembled with the corresponding cover. If the stapling function is temporarily unavailable, the third cover will be identified, but the associated content will not be prepared and the entire system will be put on hold until the stapling function becomes available, as the two covers remaining in the stack cannot be processed until the third cover is assembled with its content. Existing systems therefore cannot manage hardware downtime or unavailabilities on either system.

The Applicant therefore considered it necessary to improve the efficiency of the stage of assembling the cover and content of a printed publication.

To this end, the invention proposes an automated method for the production of printed works, each consisting of a content block and a cover, according to which:

- the feasibility of manufacturing the content blocks of the publications is determined,
- an order of priority is established for the manufacture of the printed works,
- the covers to be assembled with the content blocks are manufactured,
- the manufacture of the content blocks is ordered in descending order of priority subject to feasibility, which takes precedence over manufacturing priority, and
- the content blocks are assembled with the corresponding covers.

The method is managed or driven by a computer server that receives, for each work, manufacturing information for the content block, manufacturing information for the cover and manufacturing priority information for the printed work.

"Content block" refers here, as mentioned above, to the entire publication with the exception of the cover.

"Feasibility" here means the technical capacity of the equipment to produce the content block. To determine the feasibility of manufacturing content blocks, the content block manufacturing system transmits to the computer server information on the availability of the functions thereof.

The covers are placed in separate racks of a cover sorter, so that they may be removed at will.

Thus, due to the process of the invention, if, because of a material reason of unavailability of certain functions of the manufacturing system, a part of the publications may not be manufactured, the other publications may still be produced. When a function of the content block manufacturing system becomes available again, for example, after maintenance has taken place or if a heating device has reached the temperature required for printing, the feasibility of the content blocks is reassessed, and the list of content block manufacturing orders is updated according to the order of priority. In a "chain" manufacturing context, the unavailability of a function, even for a short period of time, does not thus block the process. This makes it possible, among other things, to avoid production backlogs by optimizing the capacities of the manufacturing system.

The invention will be better understood by means of the following description of the preferred embodiment of the invention, with reference to the accompanying drawing wherein:

FIG. 1 is a block diagram of the method of the invention.

With reference to FIG. 1, the automated process for producing printed publications, each consisting of a content block 425 and a cover 426, comprises the following steps. First, in step 410, a computer server 403 receives, for each publication, information 405 for manufacturing the content block 425, information 406 for manufacturing the cover 426 and information 407 on the manufacturing priority of the publication.

The manufacturing information for the content block comprises all the information relating to the content, format, layout and binding of the pages, as well as information relating to the steps to be taken, for example, their nature or their order, to obtain the content block ready to be assembled with the cover.

Similarly, the manufacturing information for the cover comprises all the information related to the content and to the format. It may also contain information relating to the mode of assembly of the cover and the content block.

The manufacturing priority information for the publication comprises, for example, the time frame within which manufacturing must be completed, the relative manufacturing priority of the publications in relation to each other, for example, for customers who have paid more for faster delivery.

In step 411, the computer server 403 sends the manufacturing information 406 for the cover 426 to a cover manufacturing system 402, which manufactures the cover 426 and places it in one of the racks 408*i* of a cover sorter. Six racks 408*i* are shown here, but many more may be envisaged, depending on the requirements. The system 402 may, at step 412, indicate the manufacturing of the cover and/or an identifier of the rack in which it is placed.

The cover manufacturing system is typically a system allowing the content of the cover to be printed on the appropriate medium and the format thereof to be adjusted. It may also possibly comprise creasing means, to facilitate the folding of the cover around the content block, or surface treatment means (film coating, lamination, etc.) or any other means deemed necessary by a person skilled in the art.

The racks of a cover sorter here refer to storage bins intended to separate the printed covers. Unlike in the existing systems, in which all printed covers are stacked one on top of another in a single rack as they are printed, here each cover is placed in a separate rack. This allows for covers to be removed separately at will, regardless of the order in which they were printed, and for various cover formats to be managed. It may be provided that each rack may only receive one cover, or that each rack may receive several identical covers. It may also be provided that each rack may receive several different covers, of a same format, or of different formats, or that each rack may receive all the covers corresponding to content blocks manufactured in the same sequence of steps, or any other arrangement deemed appropriate, depending on the circumstances.

In step 413, the computer server 402 asks a content block manufacturing system 401 for information 409 on the availability of the functions thereof. The content block manufacturing system 401 returns (step 414) the information 409 on the availability of its functions to the computer server 103.

The information on the availability of the functions of the content block manufacturing system refers here to a report on the operation of the elements comprised in the content block manufacturing system. This information may, for example, comprise the paper level, the ink levels available in the printer depending on the colors, the temperature of certain elements, paper jam information for a particular module, etc.

Similarly, in step 421, the computer server 402 may request from the finishing system 404 information on the availability of the functions thereof. The finishing system 404 is the module in which the covers are assembled with the content blocks.

The information on the availability of the functions of the publication finishing system 404 refers here to a report on the operation of the elements comprised in the publication finishing system. This information may, for example, comprise the functional availability of the different modules, the levels of consumables (glue, staples) available, the temperature of certain elements, paper jam information for a particular module, etc.

The computer server 403 analyzes the manufacturing priority information 407 based on the information 409 on the availability of the functions of the content block manufacturing system, the information 412 on the availability of the covers, and the information 421 on the availability of the functions of the finishing system 404 to establish an order of priority and select the content blocks 425 feasible to manufacture.

In step 415, the computer server 403 orders the system 401 to manufacture the selected content block 425.

The content block manufacturing system here refers to all the means necessary for printing, formatting, assembling and finishing the content block starting from a sheet. This may, for example, be a system as described above. It may also be any fully or partially automated system that may be used in printing to prepare the content block.

The system 401 manufactures the content block 425 and sends it to step 416 toward the finishing module 404.

At step 417, the computer server 403 orders the removal of the cover 426 corresponding to the selected content block 425 from its rack 408*i*.

In step 418, the system 402 extracts the cover from the rack 408*i* and sends it to the finishing module 404. Note that the physical step of extracting the cover to place it in the finishing module 404 may take place before ordering the manufacture of the content block, during its manufacture or even after the manufacture of the content block. Depending on the type of finishing system, it may be advantageous to use one or the other option.

In step 419, the cover and content block are assembled in the finishing module 404 to form the printed publication. Such finishing or assembly modules are well known to a person skilled in the art.

It should be noted here that the speed at which the server receives the instructions for manufacturing publications is not correlated with the actual speed of manufacture of these publications, hence the need to establish priorities in implementing the manufacturing of content blocks and covers. In particular, the following elements should be considered when envisaging all the advantages of the method of the invention:

- the computer server may receive almost simultaneously the order to manufacture a large number of publications that are different from each other;
- the manufacture of a content block, even if fully automated, takes a certain amount of time (from a few seconds to a few minutes) which is generally longer than the time required to manufacture a cover, and
- the throughput rates currently required, as well as the pressure on the costs in the field of flexible digital printing, do not allow for the underutilization of the equipment.

It is thus necessary to synchronize all the manufacturing steps of the publication as closely as possible. Compared to systems where the final assembly of the publication is determined by the availability of the cover at the top of a pile of covers, the process of the invention allows that neither the unavailability of the cover nor the unavailability of certain functions of the equipment are factors limiting the productivity of the manufacturing chain.

In the same way as the feasibility of the content blocks, the feasibility of the covers may also be communicated to the server by the cover manufacturing system. The feasibility of the covers may also be analyzed and used in the selection of content blocks to be manufactured. For example, it seems wise to try to avoid, for example, filling all the cover racks if none of the corresponding content blocks are feasible. It is therefore possible to order the manufacture of covers subject to the feasibility thereof and/or the availability of cover storage facilities.

It is obvious to a person skilled in the art that some of the steps described above may occur at the same time, and that the systems described may operate continuously.

Examples of applications of the method of the invention are, but are not limited to, the production of personalized photo albums, the production or reprinting of books "on demand".

With regard to practical embodiments for carrying out the extraction of the cover 426 from the rack 408*i* at step 418, several methods may be applicable. For example, a publication may have a unique identifier associated with the content and with the cover thereof. The server stores this identifier in memory and temporarily associates it with the specific rack where the cover is placed. When the manufacture of the content corresponding to this identifier is initiated, this same identifier is reused to identify the rack where the cover is placed in order to extract it. The unique identifier may, for example, be a bar code, a QR code, the ISBN code of the publication if it is a published book, or any other code that a person skilled in the art may consider.

Other methods may also be used, for example associating different identifiers to each component of the publication, and/or to the storage rack. Any technique that may be envisaged by a person skilled in the art may be used here.

Storing covers in multiple racks makes it possible to produce covers in different formats, which was not possible with the existing systems.

The invention claimed is:

1. Automated method for the production of printed works, each consisting of a content block (425) and a cover (426), according to which:

the feasibilities of manufacturing the content blocks (425) of the printed works is determined (414), an order of priority is established for the manufacture of the printed works, the covers (426) to be assembled with the content blocks are manufactured, the manufacture of the content blocks (425) is ordered according to descending order of priority subject to feasibility, which takes precedence over manufacturing priority, and the content blocks (425) are assembled with the corresponding covers (426), wherein the method is driven by a computer server arranged to determine the feasibilities, manage the order of priority and order the manufacture of covers and content blocks.

2. Method according to claim 1, wherein the covers (426) are stored in racks (408*i*) of a cover sorter separately from each other to be removed at will.

3. Method according to claim 1, wherein to determine the feasibility of manufacturing content blocks, the content block manufacturing system transmits to the computer server information on the availability of its functions.

4. Method according to claim 2, wherein the removal (417) of the cover (426) from its rack (408*i*) triggers the manufacture of a content block (425).

5. System comprising a computer server (403) arranged to implement the method of claim 1, comprising means for determining the feasibility of manufacturing the content blocks (425) of the publications, means for establishing an order of priority for the manufacture of the printed works, means for manufacturing and storing the covers (426) to be assembled with the content blocks, means for manufacturing the content blocks (425) according to the descending order of priority subject to feasibility, which takes precedence over manufacturing priority, and means for assembling the content blocks (425) with the corresponding covers (426).

6. System according to claim 5, wherein the means of storing the covers comprises a cover sorter wherein racks (408*i*) are provided for placing the covers separately.

* * * * *